United States Patent [19]

Lafleur

[11] 4,044,526

[45] Aug. 30, 1977

[54] METHOD AND APPARATUS FOR PACKAGING TUBULAR ARTICLES

[75] Inventor: Roger Lafleur, Greenfield Park, Canada

[73] Assignee: Imasco Limited, Montreal, Canada

[21] Appl. No.: 735,275

[22] Filed: Oct. 26, 1976

[51] Int. Cl.[2] ..... B65B 35/40; B65B 19/34

[52] U.S. Cl. ..... 53/26; 53/59 R; 53/148; 53/236; 198/425

[58] Field of Search ..... 53/26, 148, 236, 59 R; 198/425

[56] References Cited

U.S. PATENT DOCUMENTS

| | | | |
|---|---|---|---|
| 3,267,641 | 8/1966 | Molins | 53/236 X |
| 3,445,986 | 5/1969 | Godet | 53/148 |

*Primary Examiner*—Travis S. McGehee

[57] ABSTRACT

Method and apparatus for counting, collating and packaging a predetermined number of tubular articles. Known devices for handling and delivering a batch of such articles, for example cigarette tubes with filter tip, are not capable of automatically delivering and packing a predetermined number of articles. The present apparatus automatically delivers a predetermined number of articles in a packed box by the coordinated action of a counting device, separator gate and first picking plate movable horizontally towards a second picking plate so that the predetermined number of tubular articles are scooped and eventually retained between the two picking plates before removal into a waiting box.

9 Claims, 4 Drawing Figures

METHOD AND APPARATUS FOR PACKAGING TUBULAR ARTICLES

BACKGROUND OF THE INVENTION

1. Field of the Invention

The present invention relates to tube counting, collating and packaging apparatus and in particular relates to apparatus for handling cigarette tubes with filter tips.

Such empty cigarette tubes with filter tip are sold, frequently in boxes containing about 200 tubes, ready for filling with the tobacco of a smoker's choice.

A major difficulty in handling articles of this nature is that they are very much heavier at one end than at the other. As a result, their center of gravity is radically displaced to the heavier end making "automatic" handling of the article difficult. In addition, the form of the hollow paper tubes makes them susceptible to being crushed when automatically handled.

2. Description of the Prior Art

A present known apparatus delivers an approximate number of cigarette tubes for manual placement into a box. Cigarette tubes complete with filter tip are delivered continuously to a rotating fluted drum which drops two rows of tubes onto a track along which the tubes pass. After a predetermined number of revolutions of the fluted drum, a gate drops across each track and the desired number of tubes which have passed the gate are manualy collected and placed into a box for shipment. In order that at least the desired number of tubes may be collected, the number of revolutions of the fluted drum is such that the gate only drops after more than the desired number of tubes have been delivered. Thus, a slightly irregular flow of tubes to the fluted drum does not mean that less than the minimum desired number of tubes are boxed. The apparatus obviously has the disadvantage that a discreet number of tubes are not delivered for boxing, a reasonably accurate number of tubes for boxing only being delivered if an operator observes the flow of tubes to the fluted drum. Furthermore, the tubes must then be manually boxed.

SUMMARY OF THE INVENTION

The particular apparatus of the present invention may be used to automatically count, collate and package any light-weight tubular articles although the preferred embodiment is adapted to handle cigarette tubes with filter tip.

The tubes are delivered onto a relatively smooth surfaced conveyor belt from a fluted drum of known type. Thus a row of cigarette tubes in side-by-side relationship are moved past, preferably a separator plate, and a picking plate, both of which are disposed above the conveyor belt. A counting device may be associated with the fluted drum or alternatively disposed between the fluted drum and the separator plate or picking plate. Upon counting a predetermined number of cigarette tubes, the counting device preferably signals the separator plate which drops temporarily to conveyor belt level and thus prevents further downstream movement of cigarette tubes on an upstream side thereof. This separator plate movement creates an increased space between two adjacent cigarette tubes, with the predetermined number of cigarette tubes being downstream of the space. The picking plate than drops into this space and, upon horizontal downstream movement, scoops the predetermined number of cigarette tubes towards a second picking plate.

The second picking plate is disposed towards a downstream end of the conveyor belt and serves to retain the predetermined number of cigarette tubes in a close packed formation ready for removal into a waiting box.

The close packed formation of the cigarette tubes between the two picking plates, immediately prior to packaging, is assisted by flexible ribbon members which pass through vertical slots in the tube picking plates and over the cigarette tubes. Thus, the cigarette tubes are gently pressed towards the conveyor belt.

After the cigarette tubes have been removed from between the picking plates during packaging, the first picking plate returns upstream to its initial raised position above the oncoming subsequent batch of cigarette tubes on the conveyor belt.

It is accordingly an object of the present invention to provide method and apparatus which automatically counts, collates and packages a predetermined number of tubular articles.

Another object is to provide apparatus particularly suited to the handling of cigarette tubes with filter tips.

A further object is to collate cigarette tubes in a close packed formation in order to assist the effecient packaging of the tubes.

According to the present invention there is provided therefore, a method of packaging a predetermined number of articles which comprises, ascertaining the number of said articles which pass a counting means; arranging said articles in a row on conveyor means being capable of actuating separator means to locate and cease stream movement of a said article and thereby create a space between a predetermined number of said articles which have passed said separator means and following articles on said conveyor means actuating a first picking plate into a dropped position onto or adjacent said conveyor means and into said space on said conveyor means; moving said first picking plate in a downstream direction to scoop said predetermined number of articles, and simultaneously moving said separator means out of location with said article; stopping said first picking plate at a position adjacent a second picking plate, the first and second picking plate cooperating contain said predetermined number of articles therebetween; removing said predetermined number of articles from the picking plates and into a box; and returning said picking plates to initial positions for repeating the packaging operations.

In another aspect, the invention provides apparatus for packaging a predetermined number of articles which comprises conveyor means for receiving and conveying a row of said articles; counting means adjacent said conveyor means for ascertaining the predetermined number of articles which pass said counting means which then signals separator means disposed adjacent said conveyor means when a predetermined number of articles on the conveyor means has been counted, the signalled separator means then moving into a dropped position to locate, cease stream movement and thereby effect a space between a said article and said predetermined number of articles which have passed said separator means; a first picking plate disposed adjacent said conveyor means, and movable into said space and also movable horizontally in a downstream direction to a position adjacent the second picking plate, whereby the predetermined number of articles are scooped by the first picking plate, collated and retained between the adjacent first and second picking plates; and removal means associated with the adjacent first and second picking plates for packaging the predetermined number of articles into a box.

DESCRIPTION OF THE PREFERRED EMBODIMENTS

The cigarette tube packer illustrated on the drawings has been designed and developed to accept double rows of tubes from a fluted, separating drum located on the discharge end of a Molins-type tube maker to count, collate, and load a predetermined number of tubes into cardboard boxes.

Figure 1:
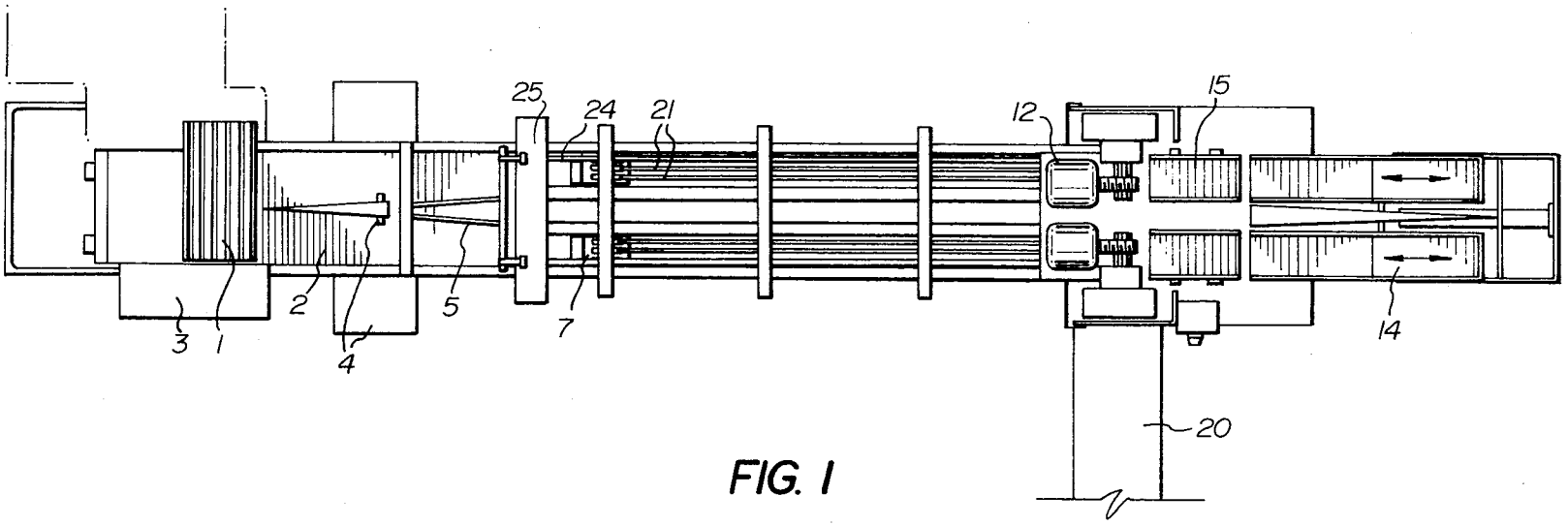
FIG. 1 is a schematic plan view of the apparatus.
Figure 2:
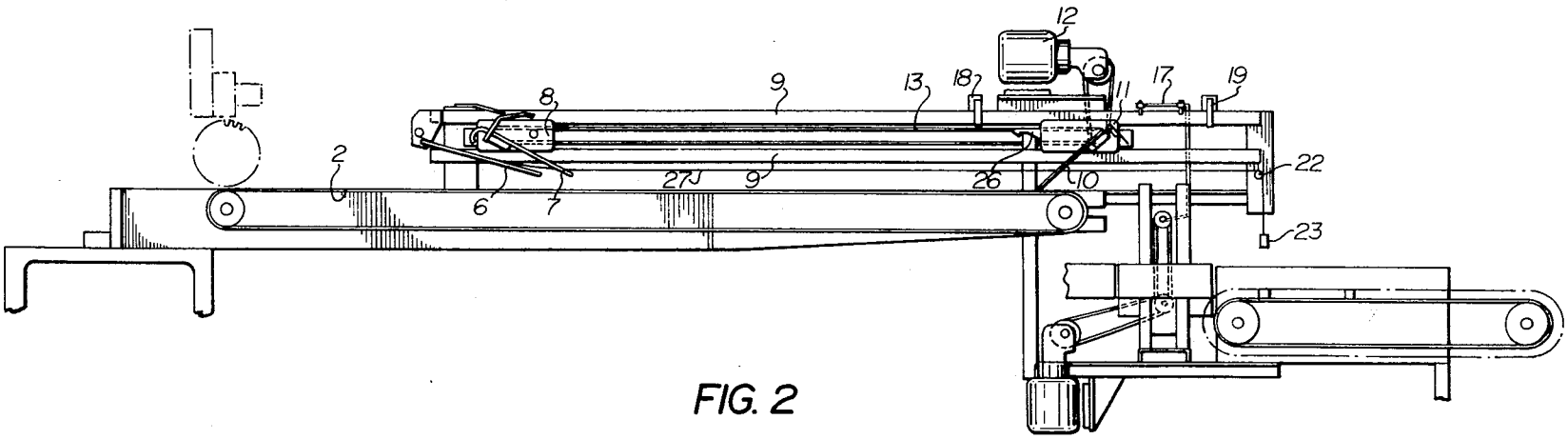
FIG. 2 is a schematic side elevation of the apparatus with a separator plate and first picking plate in an initial position.
Figure 3:
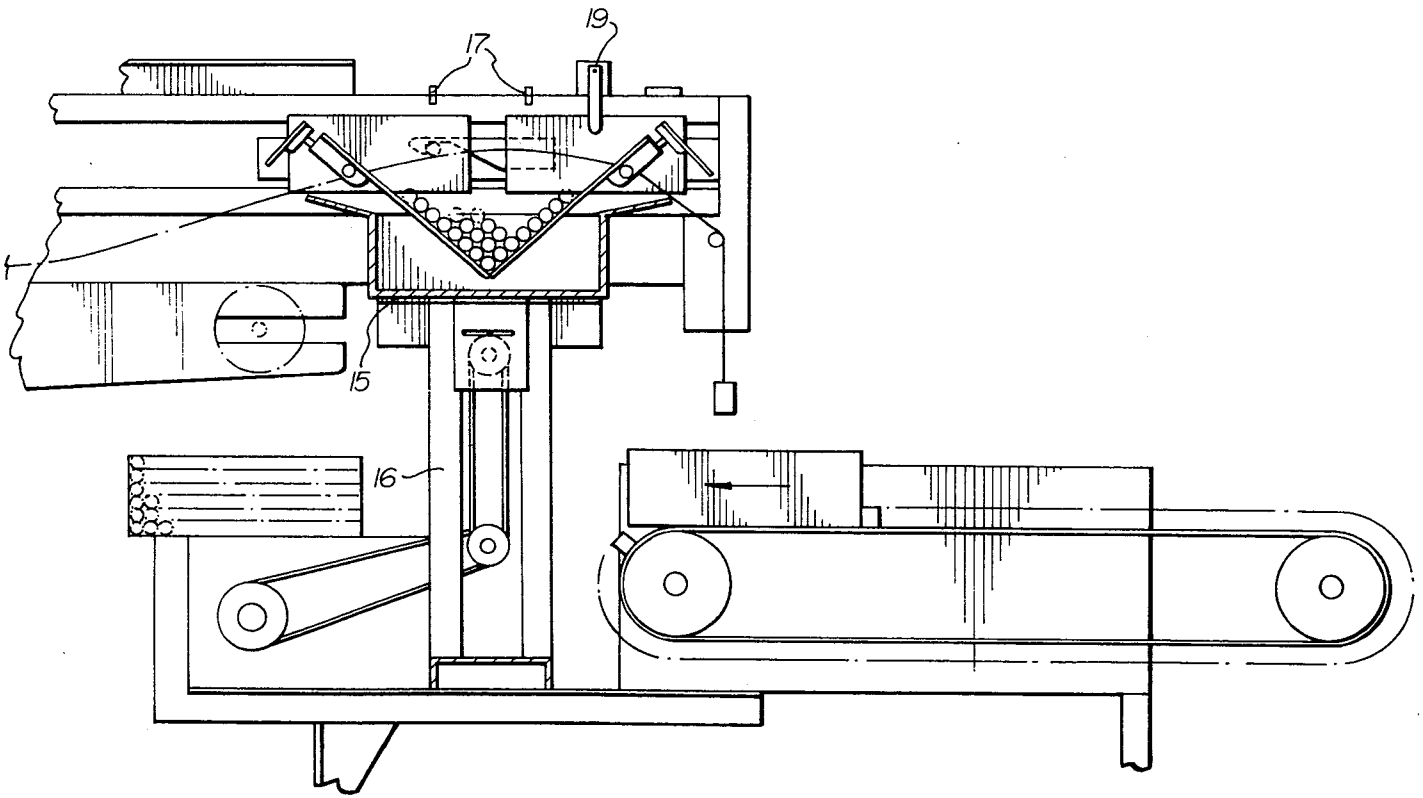
FIG. 3 is a schematic side elevation of part of the apparatus illustrated in FIGS. 1 and 2 showing the cigarette tubes collated and retained between the picking plates prior to removal therefrom.

With reference now to the drawings, and in particular to FIGS. 1 and 2, a separating drum 1 is disposed above and at one end of a conveyor belt 2 which receives two rows of tubes from the drum 1. The following description is for the processing of one row of tubes only, but applies equally to the other row. Drive means for the various moving parts on the apparatus may be common to both rows of tubes.

A counting device 3 is associated with the drum 1 so that the number of tubes being delivered to the conveyor belt 2 can be ascertained. Obviously, the counting device 3, which may be of a photoelectric type, can alternatively be stationed downstream along the conveyor belt.

An air rejector device 4 comprises a nozzle disposed at a side of the conveyor belt 2 and may be activated to reject any imperfect cigarette tubes from the conveyor belt.

A tube guide 5 disposed at one side of the conveyor belt 2 deflects the row of tubes laterally prior to passage beneath a separator plate 6 which is pivotally disposed above the conveyor belt 2. A first picking plate 7 is also pivotally disposed above the conveyor belt 2 and adjacent the separator plate 6. The first picking plate 7 is attached to a carriage 8 which is movable in a horizontal direction on carriage guides 9 positioned above the conveyor belt 2.

A second picking plate 10 extends to conveyor belt level at a downstream end of the conveyor belt 2. The second picking plate 10 is also mounted on a carriage member 11 which includes a hook portion 26, the carriage member 11 also being movable in carriage guides 9. A carriage drive motor with magnetic clutch 12 drives the carriage 8 and carriage member 11 via a conveyor chain 13 which is directly linked to carriage 8. A single drive motor may be used with either a single or double motion magnetic clutch.

A loading station is disposed downstream of the initial position of the second picking plate 10 (as illustrated in FIGS. 1 and 2). The loading station comprises an automatic box feed conveyor 14, box elevator platform 15 which is movable in a vertical direction on platform guides 16, and picking plate unlatching cams 17. A front latching member 18 and rear latching member 19, each mounted above carriage guide 9, control the latching of the first and second picking plates 7 and 10 into an upper position after they have been unlatched by the unlatching cams 17 during a loading operation. The latching mechanisms will be further described hereinbelow.

A box conveyor 20 is disposed below the conveyor belt level for receiving a full box from the box elevator platform 15 when the latter is in a lowermost position adjacent the automatic box feed 14. The box conveyor 20 moves the full boxes laterally a distance of approximately two box widths at the end of a cycle after they have been pushed off platform 15 onto the box conveyor 20.

Two silk ribbons 21 are attached to the separator gate 6. The ribbons 21 each pass through a slot in the first picking plate 7 and the second picking plate 10, over a pulley 22 and terminate in a weight 23. The weight 23 maintains the ribbons 21 under tension and the pulley 22 permits movement as the separator gate 6 alters position. A third, slightly wider silk ribbon 24 effectively holds the filter tip end of the tubes down on the conveyor belt 2 the third ribbon 24 being attached to the chassis of the apparatus at point 25. As the first picking plate 7, together with the scooped tubes, approaches the second picking plate 10, the tubes are gently forced down toward the conveyor belt 2 into a close packed formation. The ribbons 21 and 24 thus provide positive control of the tubes at all times during and after passage downstream of the first picking plate 7, whilst the close packed formation of the tubes prior to unloading assists them to more efficiently loaded into a box when the picking plates separate.

Figure 4:
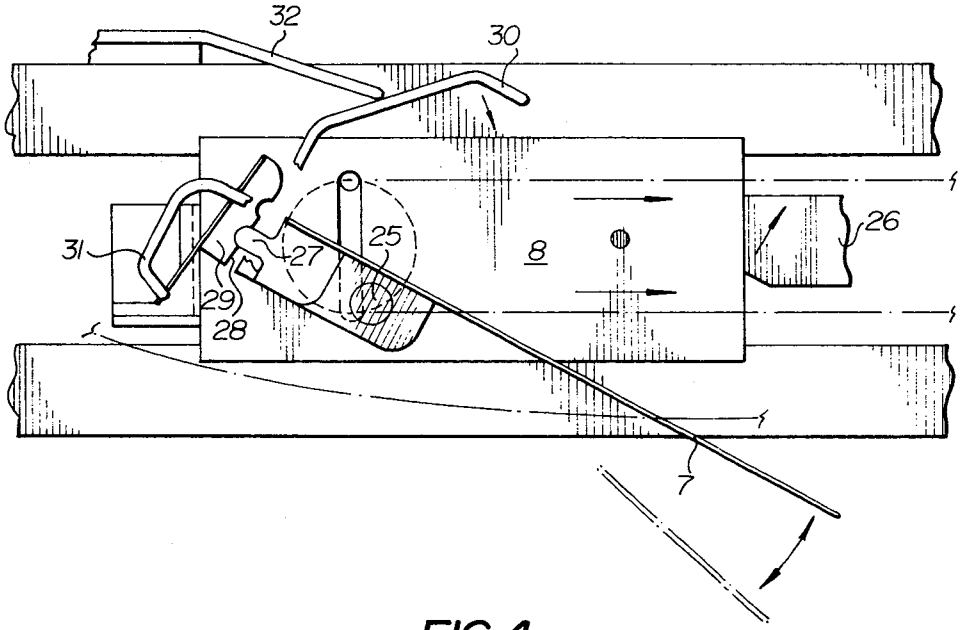
FIG. 4 is a side elevation illustrating a particular latching mechanism for the first picking plate.

With particular reference now to FIG. 4, the first picking plate 7 is pivotally attached to the carriage 8 by a fin 25. A lug 27 on the picking plate 7 is movable over a cam surface 28 of a spring member 29 which is biased towards the lug 27.

Two arms 30 and 31 extend from the picking plate 7, these arms locating members fixed on the apparatus chassis to control the positions of the picking plate 7. Arm 30 locates member 32 in order to lower the picking plate 7 to the level of the conveyor belt 2, the lug 27 moving over cam surface 28 into cam upper recess therein. Arm 30 also locates one of the unlatching cams 17 as the latter moves down, the picking plate being unlatched into a vertical hanging position.

Arm 31 locates the front latching member 18 as the carriage 8 moves the first picking plate 7 upstream, the lug 27 thereby being forced over the cam surface 28 into a lower recess therein so that the first picking plate 7 is moved upstream above the tubes on the conveyor belt 2.

The second picking plate 10 has similar arms for latching and unlatching upon cooperation with rear latching member 19 and are of the unlatching cams 17 respectively.

The apparatus operates as follows. At the beginning of the production run, the air reject mechanism 4 is switched on so that all tubes are rejected until the operator has completed adjustment of the apparatus and ensured that a satisfactory flow of tubes is obtained. The air rejector mechanism 4 is then turned off and the row of tubes, in side-by-side relationship, is moved on the conveyor belt 2 beneath separator gate 6 and the first picking plate 7 which are both in a raised position above the conveyor belt 2. The counting device 3 signals the separator gate 6 when the predetermined number of tubes has been reached.

The signaled separator gate 6 drops substantially to conveyor belt level and locates a tube momentarily stopping the tube and following tubes from further downstream flow. The conveyor belt surface is designed so that the tubes may slide over the conveyor belt surface when touched by the separator gate 6. This location of a tube by separator gate 6 causes a space to be formed between groups of tubes of the predetermined number.

As soon as space is created, the first picking plate 7 is actuated, drops into position in the space and commences downstream movement toward the second picking plate 10 whilst simultaneously scooping tubes on the conveyor belt 2. The tensioned silk ribbons 21 and 24 hold the cigarette tubes down on the conveyor belt 2 in close packed formation.

When the first picking plate 7 reaches the second picking plate 10 the carriage 8 is linked to the carriage member 11 by means of the hook 12. The two carriages with their respectible picking plates are then moved further behond the end of conveyor belt 2 to the loading station above an empty box. The unlatching cams 17 are tripped as the elevator platform 15 ascends to release the picking plates 7 and 10 and the predetermined number of tubes fall into the empty box.

The box, now filled with the predetermined number of tubes, is lowered on platform 15 and pushed therefrom onto a box conveyor 20 by an oncoming empty box from the automatic box feed 14. The elevator platform 15 simultaneously receives an empty box in readiness for the next predetermined number of tubes. Upon the arrival of the next predetermined number of tubes between the picking plates 7 and 10, the elevator platform 15 ascends on platform guides 16 upon receiving a signal from carriage member 11.

As carriage 8 and carriage member 11 return in an upstream direction, latching mechanisms 18 and 19 raise the first picking plate 7 and second picking plate 10 respectively to their initial positions, and carriage 8 is released from hook 26 by an upstanding pin so that the first picking plate 7 is returned to its initial horizontal position adjacent the separator gate 6. The above described cycle is completed before the following predetermined number of tubes have passed in toto beneath the separator gate 6.

The above description covers the sequence for one stream of tubes but is identical to the sequence for the second stream. It will be appreciated that the apparatus in the above described preferred embodiment may also be used for counting other tubular articles and accordingly it is not intended that the present invention be restricted to apparatus for counting only cigarette tubes with filter tips.

What I claim as my invention is:

1. A method of packing a predetermined number of articles which comprises, ascertaining the number of said articles which pass a counting means;

arranging said articles in a row on conveyor means; said counting means being capable of actuating separator means to locate and cease downstream movement of a said article and thereby create a space between a predetermined number of said articles which have passed said separator means and following articles on said conveyor means;

actuating a first picking plate into a dropped position onto or adjacent said conveyor means and into said space on said conveyor means;

moving said first picking plate in a downstream direction to scoop said predetermined number of articles, and simultaneously moving said separator means out of location with said article;

stopping said first picking plate at a position adjacent a second picking plate, the first and second picking plates cooperating to retain said predetermined number of articles therebetween;

removing said predetermined number of articles from the picking plates and into a box; and returning said picking plates to initial positions from repeating the packaging operation.

2. The method of claim 1 comprising the further steps of moving the first and second picking plates together when the first plate is adjacent the second picking plate into a position above an empty box; and separating said first and second picking plates to permit the predetermined number of articles to fall into the empty box.

3. The method of claim 1 comprising the further step of holding the predetermined number of articles in a close packed formation between said first and said second picking plate.

4. Apparatus for packaging a predetermined number of articles which comprises conveyor means for receiving and conveying a row of said articles;

counting means adjacent said conveyor means for ascertaining the predetermined number of articles which pass said counting means which then signals separator means disposed adjacent said conveyor means when a predetermined number of articles on the conveyor means has been counted, the signalled separator means then moving to locate, cease stream movement and thereby effect a space between a said article and said predetermined number of articles which have passed said separator means;

a first picking plate disposed adjacent said conveyor means and movable into said space and also movable horizontally in a downstream direction to a position adjacent a second picking plate, whereby the predetermined number of articles are scooped by the first picking plate, collated and retained between the adjacent first and second picking plates; and removal means associated with the adjacent first and second picking plates for packing the predetermined number of articles into a box.

5. Apparatus according to claim 4 wherein the picking plates form a V-configuration when said first picking plate is at said position adjacent said second picking plate.

6. Apparatus according to claim 5 further comprising unlatching means for releasing said first and said second picking plates from the V-configuration whereby said predetermined number of articles fall therefrom into said box.

7. Apparatus according to claim 4 further comprising at least one tensioned flexible ribbon member attached to said separator gate and passing through said first and said second picking plates in a direction substantially parallel to said conveyor means whereby said articles are biased towards said conveyor means and into a close packed formation when the picking plates are adjacent each other.

8. Apparatus according to claim 4 wherein said separator means comprises a separator gate disposed above said conveyor means and upstream of said first picking plate, said separator gate being movable into a dropped position to locate said article.

9. Apparatus according to claim 4 wherein said separator means comprises said first picking plate which locates a said article before dropping further to scoop said predetermined number of articles.

* * * * *